United States Patent [19]

Cristiani

[11] 4,081,312

[45] Mar. 28, 1978

[54] PAPER TAPE SPLICER FOR CIGARETTE MAKERS

[76] Inventor: Athos Cristiani, Via Don Luigi Sturzo 7, Bologna, Italy

[21] Appl. No.: 738,922

[22] Filed: Nov. 4, 1976

[30] Foreign Application Priority Data

Jan. 14, 1976 Italy ..... 12413 A/76

[51] Int. Cl.[2] ..... B65H 19/18; B65H 19/20

[52] U.S. Cl. ..... 156/504; 156/513

[58] Field of Search ..... 156/502, 504, 507, 513, 156/159, 157; 269/21; 83/556, 558, 563; 242/58.1, 58.2, 58.3, 58.4

[56] References Cited

U.S. PATENT DOCUMENTS

| | | | |
|---|---|---|---|
| 2,976,037 | 3/1961 | Seel et al. | 269/21 |
| 3,013,930 | 12/1961 | Serbin | 156/502 |
| 3,138,341 | 6/1964 | Stone | 242/58.4 |
| 3,227,594 | 1/1966 | Ryan | 156/159 |
| 3,896,820 | 6/1975 | Ludszeweit et al. | 156/504 |

*Primary Examiner*—William A. Powell
*Assistant Examiner*—William H. Thrower
*Attorney, Agent, or Firm*—Spencer & Kaye

[57] ABSTRACT

A tape splicer with suction heads which removes the tail of the depleted tape and perforates the tape on both sides of the splice; the novelty being limited to some structural details.

13 Claims, 3 Drawing Figures

BR
M2
NR
G
A
F
L
NS
BS
M1

III
107
206
207
8
106
5
9
105
6
16
11
104
12
23
G
15
NR
3
14
4
NS
101
13
2
1
102
201
S
III

PAPER TAPE SPLICER FOR CIGARETTE MAKERS

This invention is generally directed to continuous feed mechanisms for tape or strip shaped material and more particularly to apparatus for quick splicing the tape from a depleted tape bobbin to the leading end of a tape from a standby tape bobbin.

Although not exclusively limited to cigarette makers, the present invention is particularly adapted for use in feed systems, as shown in my U.S. Pat. No. 3,878,979, for paper tape which is continuously fed to the rod forming section of a cigarette maker for wrapping a continuous tobacco braid thereby producing a continuous cigarette rod which is subsequently cut into individual cigarettes of equal lengths. When a cigarette with a tape splice is inspected, it will be rejected. If overly longtails of tape are involved in the splice, two or three cigarettes may be rejected. Even more important, such cigarettes may not be glued longitudinally along their full lengths and may open up and hinder normal operation of the maker or the machine down stream therefrom.

Accordingly, an object of the present invention is to provide an improved quick splicer particularly adapted for continuous feed paper tape systems.

Another object of the present invention is to provide the foregoing splicer which makes a splice with a minimal residual free trailing end or tail.

And another object of the present invention is to provide the foregoing splicer which flangs the splice for pneumatic inspection means.

The foregoing and other objects and advantages will appear more fully hereinafter from a consideration of the detailed description wherein one embodiment of the invention is illustrated by way of example. It is to be expressly understood, however, that the drawing is for illustration purposes only and is not to be construed as defining the limits of the invention.

Figures 1, 2:
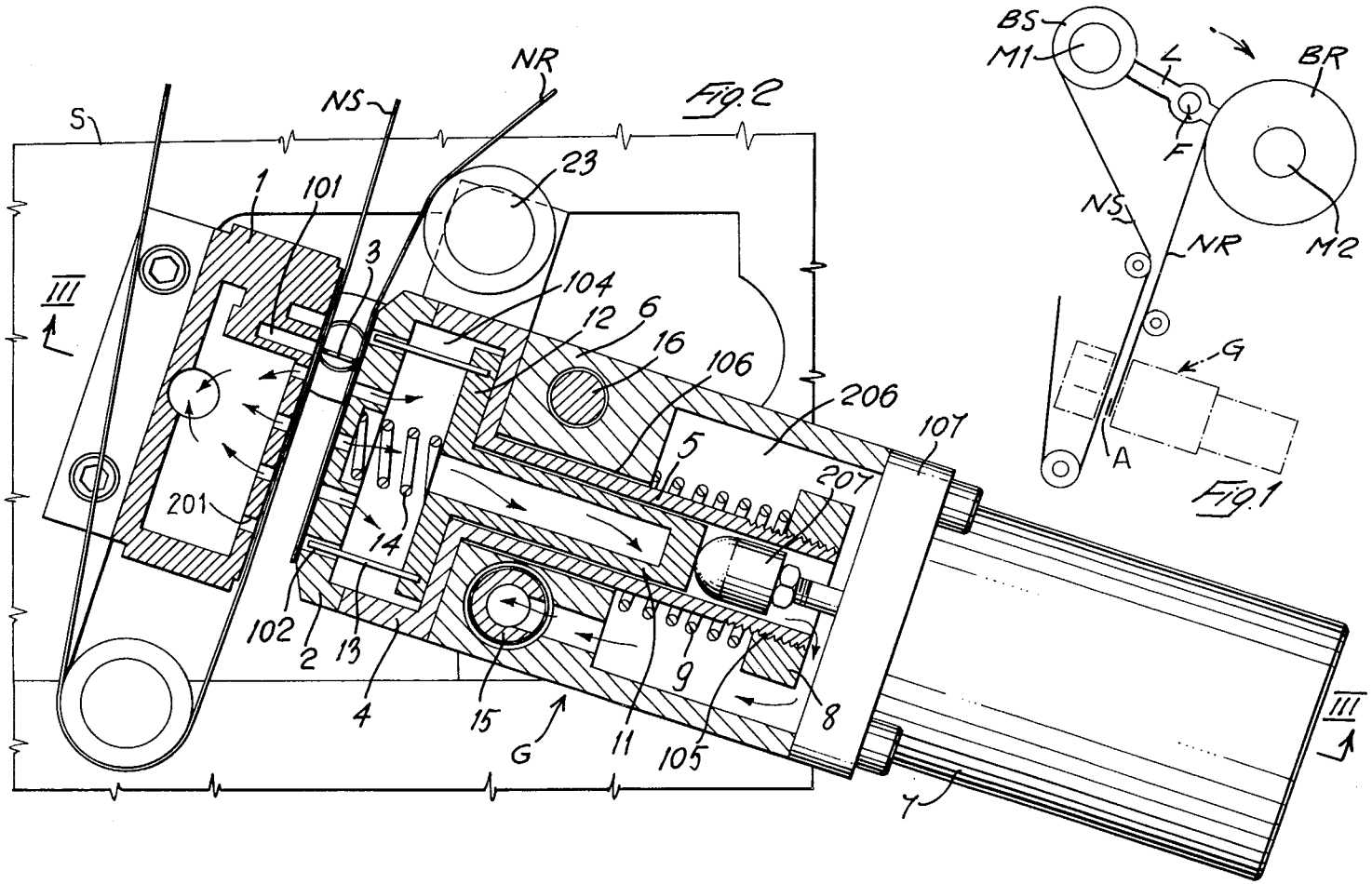
FIG. 1 is a schematic view of the supply portion of a tape feed system incorporating a splicer made in accordance with the present invention.
FIG. 2 is a sectional view of a splicer made in accordance with the present invention and viewed in the same plane as the splicer of FIG. 1.

With reference to the drawings and in particular to FIG. 1, a quick splicer G made in accordance with the present invention is provided immediately downstream from a bobbin type tape feeder or supply having a pair of spindles M1 and M2 at the opposite ends of a switching arm L which is pivotable or rotatable on a central axis or support F. The tape NS presently being used is being unwound from a bobbin BS on the spindle M1 and the standby or reserve tape NR is wound on a bobbin BR on the spindle M2.

The bobbin mounting and depletion signal means may be as shown in my aforementioned patents or may be of any equivalent arrangement. Although it is preferable to utilize automatic depletion signal means to activate the novel splicer G, if desired manual splicer activating means can be used. The tape NS being used is fed through the splicer G which also receives the lead end of the standby or reserve tape NR which is appropriately positioned and is provided with any suitably adhesive means A. Upon activation, the splicer G will immediately, without interrupting the flow of tape, splice the lead end of tape NR to the tape NS, sever the tape NS adjacent the splice and flag the splice for pneumatic inspection means, as will be further described.

Figure 3:
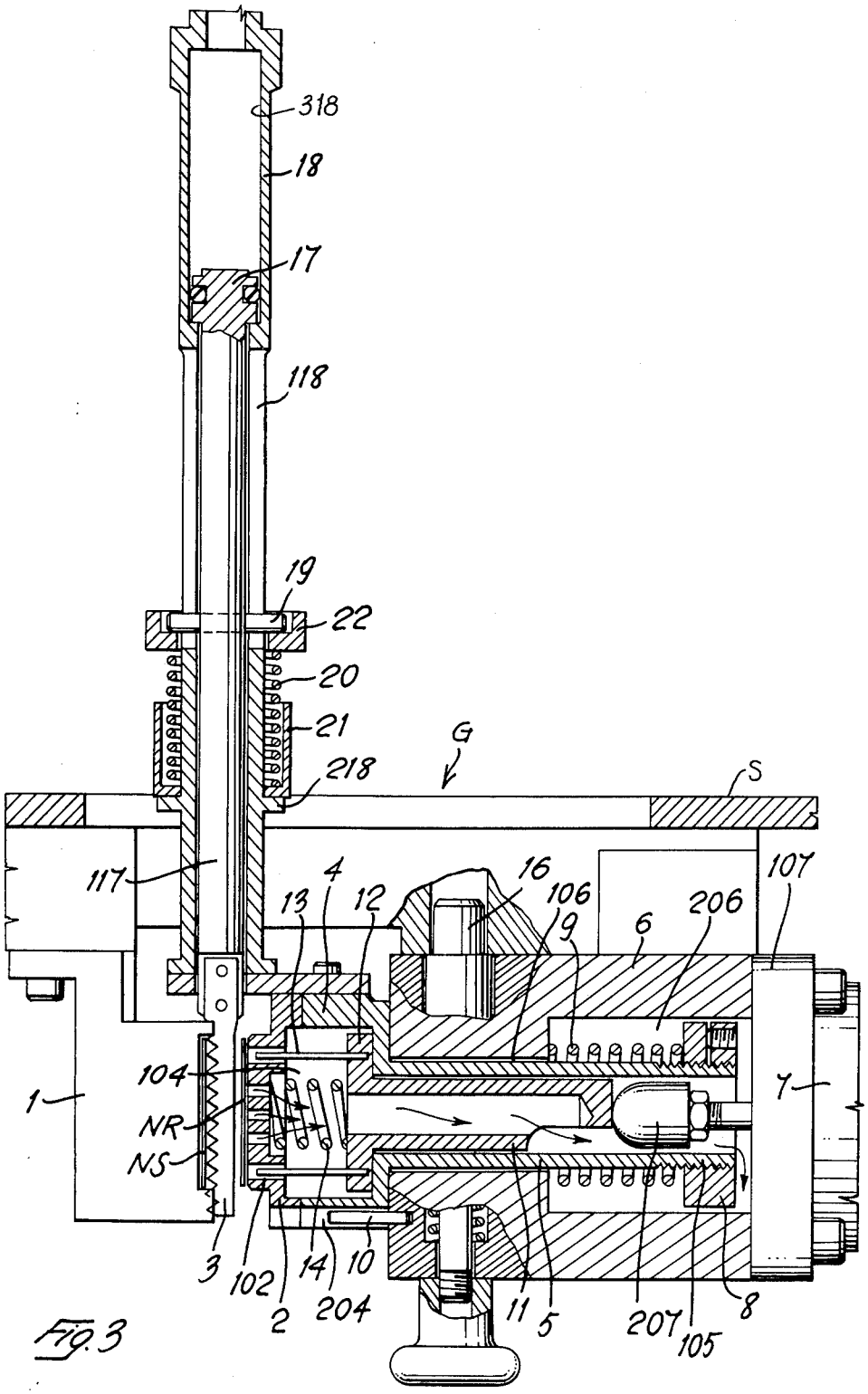
FIG. 3 is a sectional view taken on line III—III of FIG. 2.

Referring now to FIGS. 2 and 3, the splicer G in accordance with the present invention is provided with a fixed suction block 1 mounted on structure S; a movable suction pressing means having a suction pressing member 2, and pivotally mounted on the structure S for movement between its operating position, as shown, and a loading position; and tape severing means including a rectractable saw toothed knife 3 which is shown in its extended operating position.

The fixed block 1, connected to suction, is provided with a transverse slot 101 for receiving the knife 3 and a plurality of openings 201 in its face for flow of air to maintain the moving tape NS on the face of the block.

The suction pressing means is provided with a hollow block or cylinder 6 having an axial opening or bore 106 which is enlarged at its back end to form a cavity or chamber 206 the end of which is closed by an electromagnetic operator or solenoid 7 having a mounting flange 107 connected to the rear end of the cylinder 6. The cylinder 6 is connected at its forward end to the fixed structure S by a hollow member or shaft 15 which also communicates with and connects the chamber 206 to suction. The cylinder 6, and therefore the suction pressing means, is movable on the member 15 from its operating position (as shown in FIGS. 1 and 2) clockwise approximately 75° to 90° to its loading position, and is releasably locked in each position by a spring loaded, manual latch 16.

The suction pressing means is also provided with an inner and an outer piston. The outer piston is essentially formed by a hollow block or head 4 which defines a chamber 104 and a tubular stem or sleeve 5 which extends rearwardly from the head 4 through the bore 106 into the chamber 206. A helical spring 9 on the stem 5 is compressed between the forward wall of the chamber 206 and a ring nut 8 threaded on the stem end 105 to bias the outer piston to its retracted position in which the head 4 abuts the front of the cylinder 6. To limit the outer piston to longitudinal or axial movement and to prevent rotation, a pin 10 mounted in the front end of the cylinder 6 extends forwardly therefrom into a groove or slot 204 in one side of the head 4. The suction pressing member 2 is fastened on to the head 4 thereby forming the face of the outer piston and is provided with a plurality of openings or holes 102 for air flow into the chamber 104 to hold the lead end of the tape NR.

The inner piston is comprised of a tubular stem 11 slidable in the stem or sleeve 5 with a head 12 at its front end disposed in the chamber 104. A spring 14, stronger than the spring 9, is disposed in the chamber 104 and is retained between the head 12 and the suction pressing member 2 for biasing the inner piston to its rearmost or retracted position with the head 12 abutting the rear wall of chamber 104 and the end of the stem 11 being held against an activating element 207 on the end of the plunger of the solenoid 7. It should be seen that the hollow stems 11 and 5 flow connect the chamber 104 to the chamber 206 which is connected to suction by the member 15 to induce air flow through the holes 102. The head 12 is provided with a plurality of pins 13, preferably four in number, each of which extends into an opening 102 which is axially aligned with an opening 201 in the fixed block 2. The pins 13 function to limit the inner piston to axial movement and prevent rotation, and to pierce tapes NR and NS in the area of a splice being made to flag the splice for subsequent pneumatic testing.

The tape severing means is mounted on the movable suction pressing means. A pneumatic cylinder 18 is mounted at one end on the head 4 of the outer piston and is provided with a pressure chamber 318 at its other end. Spaced from its mounted end, the cylinder 18 is provided with an annular flange or collar 218 and a pair of diametrically opposed longitudinally slots 118 disposed between the flange 218 and the chamber 318. A rod or plunger 117, slidably disposed in the cylinder 18, is provided at one end with a piston or head 17 disposed in the chamber 318 and the knife 3 is connected to its other end.

The rod 117 is provided, intermediate its ends, with a cross-pin 19 which extends through the slots 118 and prevents the rod from rotating to maintain the orientation. The pin 19 will move along the slots 118 as the rod moves axially in the cylinder 18. A helical spring 20 between two cup shaped ring seats 21 and 22 are provided on the cylinder 18; the spring biasing its seat 21 against the flange 218 and its seat 22 against the pin 19. The purpose of the spring 20 is to bias the rod 117 to its retracted position with the head against the outer or pressure inlet end of the chamber 318 and the knife 3 retracted into the connected end of the cylinder 18. To extend the knife 3 to its operative position, as illustrated in the drawings, when a splice is to be made, pressure is provided to the chamber 318 which acts on the head 17 moving the rod 117 against the spring 20 until the knife 3 is positioned between the faces of the blocks 1 and 2 or tapes NS and NR with its saw toothed edge facing the tape NS.

As shown in FIG. 2, an idler roller 23 for the tape NR is mounted on the side of the head 4 closest to the bobbin BR.

In accordance with the invention, when the tape NS of the unwinding bobbin BS (tape which is guided to slide on fixed block 1) is about to finish, the machine operator withdraws latch 16 and turns the cylinder or block 6 clockwise until suction pressing member 2 is in a substantially horizontal position. A suitable adhesive or a piece of biadhesive tape A is applied to the leading end of the standby or reserve tape NR and leading end so prepared for the adhesion is suitably positioned on the suction pressing member 2. The cylinder or block 6 is unlatched and rotated counterclockwise back to the initial position with pressing member 2 in face to face alignment with suction block 1, and locked in position by latch 16. Since the foregoing operations or preparation require some time, the operator's intervention must be timely. For this purpose a warning device, operated by an appropriately calibrated bobbin sensing unit, can be provided.

After this preparation, when the unwinding bobbin BS reach a predetermined degree of unwinding where it is considered to be depleted, an appropriately calibrated sensing unit causes the energization of a solenoid control valve (not shown) which supplies pressure fluid or compressed air to the chamber 318 of the cylinder 18. The pressure fluid entering the chamber 318 acts on the head 17 moving the rod 117 against the bias of the spring 20 and the knife 3 out of the cylinder 18 to its operative position (as shown in FIG. 2) between the block 1 and member 2 with its saw teeth facing the unwinding tape NS.

After a predetermined interval of time or delay from the time the solenoid control valve was energized and the knife 3 is moved to its operative position, appropriate control means (not shown) will energize the electromagnetic actuator or solenoid 7. This interval of time can be provided, for instance, to allow the formation of an adequate stock of loose tape in a temporary storage area, for instance, as is shown described and claimed in my U.S. Pat. No. 3,878,979.

Energization of the electromagnetic actuator or solenoid 7 causes its plunger and actuating member 207 to urge the inner piston (head 12 and stem 11) toward the fixed block 1. The action of the spring 14 will cause the outer piston (member 2, head 4 and stem 5) to move against the bias of the spring 9 and with the inner piston toward the fixed block 1. This movement of the inner and outer pistons causes the member 2 to press the lead end of the tape NR with the adhesive A against the tape NS to make a splice and, simultaneously, carries the knife 3 into the slot 101 in the fixed block 1 and sever the tape NS trailing the splice.

Continued movement of the inner piston against the bias of spring 14 causes the head 12 to move the pins 13 out of the openings 102, through the tapes NR and NS and into aligned openings 201 in block 1 thereby perforating of flaging the splice area which will be detected by subsequent inspection of the cigarette with the splice by a pneumatic cigarette ends detector.

Thereafter, the appropriately timed controls for the splicer G deenergizes the electromagnetic actuator or solenoid 7, and the springs 9 and 14 move or return the inner and outer pistons to their retracted positions. Similarly the controls deenergize the solenoid valve removing the compressed air supply to the chamber 318 of the cylinder 18 permitting the spring 20 to move the plunger 117 and retract the knife 3.

This axial retraction of knife 3 is necessary to prevent tape NR so spliced from interfering with the knife when bobbin holding arm L turns in the direction which brings bobbin BR of stand-by tape NR to the place occupied by bobbin BS, just depleted. After this rotation which is of 180°, tape NR will lie on fixed suction block 1, along which it will slide as a new feed tape. The depleted bobbin BS can now be replaced and the novel splicer G is ready to be reloaded for a subsequent splice when the tape NR nears depletion.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A splicer for joining the adhesive side of the leading end of a standby bobbin to a depleting tape being used from an unwinding bobbin in a multibobbin paper wrapper tape feeding unit of a cigarette making machine, comprising a fixed suction means for guiding the tape being used comprising a hollow block fixedly mounted to structure, connected to suction and having a face portion with a plurality of openings therethrough on which the tape being used is guided; and suction pressing means receiving and retaining the leading end of the standby tape positioned thereon, and when activated pressing the adhesive side of the leading end of the standby tape against the tape being used to splice the tapes;

said suction pressing means being provided with extendible means for severing the trailing portion of the tape being used adjacent to and simultaneously with the splice being made and for sequentially perforating the tapes in the splice area to flag the splice for pneumatic inspection means, and further comprising a cylinder mounted on structure and having a central bore enlarged at the back end thereof defining a chamber connected to suction;

an outer piston having a hollow head defining a chamber therein and a tubular stem movable axially in said central bore and providing communication from the chamber in the head to the chamber defined by said cylinder;

said head of said outer piston being provided with a suction pressing member with a plurality of openings therethrough being in spaced face to face alignment with said fixed suction block and receiving and retaining the leading end of the standby tape;

spring means disposed in said chamber defined by said cylinder biasing said outer piston to its retracted position;

electromagnetic actuation means mounted on said cylinder and when energized urging said piston to move against the bias of said spring means toward said fixed suction means for splicing said tapes;

an inner piston having a head disposed in the chamber defined by said head of said outer piston, a stem extending from said head movable axially in said stem of said outer piston, and a central opening through said head and stem providing communication between said chambers defined by the head of said outer piston and said cylinder;

a spring disposed in said chamber defined by the head of said outer piston between said suction pressing member and said head of said inner piston biasing said inner piston against the back wall of said outer piston head;

a plurality of pins mounted on said inner piston head each extending into a different opening in said suction pressing member; and said actuating means having a plunger engaging said inner piston stem to urge when said actuating means is energized both said inner and outer pistons to move in unison against the bias of said spring means toward said fixed suction means until a splice is made and thereafter urging said inner piston to move against the bias of said spring causing said pins to move through said tapes, each pin moving into an aligned opening in said fixed suction means.

2. The splicer in accordance with claim 1, and said suction pressing means further comprising tubular means providing suction to said chamber defined by said cylinder;

said cylinder being rotatable on said tubular means between and operating position and a tape loading position; and a manual latch means for releasably locking said suction pressng means in each position.

3. The splicer in accordance with claim 2, and said tape severing means being mounted on said head of said outer piston.

4. The splicer in accordance with claim 3, and said tape severing means comprising a tubular member mounted at one end on the outer piston head and having a pressure chamber in its other end;

a plunger movable axially in said tubular member and having a knife attached to its end in the mounted end of said tubular member;

a spring member biasing said plunger toward said pressure chamber retaining said knife within said mounted end of said tubular member; and said plunger having a head in said pressure chamber and responsive to pressure fluid therein immediately before a splice is to be made for moving said plunger against the bias of said spring member and said knife to a position between said fixed suction means and said suction pressing member.

5. Splicer for quick in-line splicings between the trailing end of an unwinding bobbin and the leading end of a stand-by bobbin, destined to reintegrate the depleted unwinding bobbin, in a continuous tape feeding unit, in particular, wrapper paper tape in cigarette making machines, characterized by the fact that is comprises: a suction block on which the unwinding tape is guided to slide, in its path from said feeding unit to the user; a suction pressing unit, frontally facing the suction block and movable with driving means towards and against the suction block, this pressing unit having set and pneumatically held stationary on it the leading end of the stand-by tape provided with an externally applied adhesive; and a knife axially mounted free to slide whenever required, in an actuation support, integral with the pressing unit which can be moved against the suction block; this knife being in a position to be alternately moved, with driving means which are synchronized and timed with the pressing unit driving meas, between a waiting position, in which it clears the interspace between the suction block and the pressing unit, and a cut presetting position, in which it transversely lies in that interspace, with the blade cutting edge on the unwinding tape pneumatically engaged by the fixed suction block, and the back of the blade against the reintegrating tape held by the movable pneumatic pressing unit; an accommodating slit being formed in the fixed pneumatic block, for the knife blade, which enters sideways into it, thus splitting the trailing end of the unwinding tape while the pressing unit is frontally moved against the fixed suction block, thus splicing the leading end of the stand-by tape with the trailing end of the unwinding tape, in the close proximity of the cut made by the knife.

6. Splicer according to claim 5 in which the cutting edge of the blade is saw-toothed so as to cut the unwinding tape trailing end simultaneously along the whole tape width, while the blade advances, entering the slit of the fixed suction block.

7. Splicer according to claim 6 in which the said movable suction pressing unit is springguided in a guiding body fitted also with means for controlling the displacement of the pressing unit against the suction block, these means preferably consisting of an electromagnet.

8. Splicer according to claim 7, in which the movable pressing unit guiding body is pin-fitted on one part of the machine fixed frame in such a way as to be in a position to be angularly moved between an operating position, in which it maintains the pressing unit frontally against the splicer fixed suction block, and a position of preparation, in which the pressing unit suction face horizontally faces the top ready to receive and the pneumatically hold the leading end of the reintegrating tape, appropriately prepared with adhesive.

9. Splicer according to claim 8 in which suitable locking means, which can be actuated and stopped at will, and in particular a hand-operated latch or pin, lock in position said sprung slidable pressing unit guiding body, in its operating position, facing the fixed pneumatic block.

10. Splicer according to claim 9 in which the axially movable knife actuating support comprises a pneumatic cylinder, with the knife axially fastened to the plunger stem, while the cylinder body is fastened to one part of said movable suction pressing unit.

11. Splicer according to claim 10, in which the pneumatic cylinder is of the single-acting type and is active during the blade cut presetting displacement between the fixed suction block and the pressing unit, against the counteracting action of a return spring, which brings the blade back into its waiting position, out of the interspace between the fixed suction block and the pressing unit.

12. Splicer according to claim 11 in which the movable pressing unit springing comprises a pusher which transmits the electromagnet actuating to the pressing unit through at least one helical loading spring, and has, interspaced between each other two rows of pins arranged in a comb fashion, which come out of corresponding openings of the pressing unit suction face, when the pusher motion exceeds the pressing unit requirements, thus making holes through the tapes, which are transversely adjacent to the splicing area, while splicing is being performed, said holes presetting for rejection the cigarette (s) which comprise the spliced part.

13. Splicer according to claim 12 in which said pressing unit springing comprises a compressed helical spring acting as a spring which returns the pressing unit towards the respective guiding body, when the electromagnet action on the pusher fails, while the latter is retracted due to the opposition of the spring acting between it and the pressing unit, charging itself during the advance.

* * * * *